US011560859B1

(12) United States Patent
Kiwan et al.

(10) Patent No.: US 11,560,859 B1
(45) Date of Patent: Jan. 24, 2023

(54) METHODS AND SYSTEMS FOR DIAGNOSING NON-DEACTIVATED VALVES OF DISABLED ENGINE CYLINDERS

(71) Applicant: Ford Global Technologies, LLC, Dearborn, MI (US)

(72) Inventors: Rani Kiwan, Canton, MI (US); Adam Krach, Canton, MI (US); Scott Richard Hughes, Bloomfield Hills, MI (US); Richard Shimon, Troy, MI (US); Kathleen Grant, Farmington Hills, MI (US); David Wyman, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/648,908

(22) Filed: Jan. 25, 2022

(51) Int. Cl.

| | |
|---|---|
| ***F01L 13/00*** | (2006.01) |
| ***F02D 13/06*** | (2006.01) |
| ***F02D 41/22*** | (2006.01) |
| ***F02D 41/00*** | (2006.01) |

(52) U.S. Cl.
CPC ..... *F02D 41/008* (2013.01); *F01L 13/0005* (2013.01); *F02D 13/06* (2013.01); *F02D 41/0087* (2013.01); *F02D 41/22* (2013.01); *F02D 41/221* (2013.01); *F01L 2013/001* (2013.01); *F01L 2800/11* (2013.01); *F02D 2200/0406* (2013.01); *F02D 2200/0414* (2013.01); *F02D 2200/101* (2013.01)

(58) Field of Classification Search
CPC ..... F01L 13/0005; F01L 2013/001; F01L 2800/11; F02D 13/06; F02D 41/0087; F02D 41/221
USPC ..... 73/114.79; 123/198 F, 481; 701/109
See application file for complete search history.

(56) References Cited

U.S. PATENT DOCUMENTS

| | | | | |
|---|---|---|---|---|
| 5,721,375 | A * | 2/1998 | Bidner | F02D 41/0087 701/101 |
| 7,063,057 | B1 * | 6/2006 | Waters | F02D 41/221 123/90.16 |
| 9,890,732 | B2 * | 2/2018 | Younkins | F02D 13/06 |
| 10,253,706 | B2 * | 4/2019 | Kotwicki | F02D 13/06 |
| 2010/0031738 | A1 * | 2/2010 | Feldkamp | G01M 15/042 73/114.79 |
| 2010/0175462 | A1 * | 7/2010 | Doering | F02D 13/06 701/112 |

(Continued)

*Primary Examiner* — Erick R Solis
(74) *Attorney, Agent, or Firm* — Vincent Mastrogiacomo; McCoy Russell LLP

(57) ABSTRACT

Methods and systems are provided for a diagnostic routine of a variable displacement engine (VDE) of a vehicle to detect non-deactivated valves of deactivated cylinders due to a degraded valve deactivation mechanism. In one example, a method comprises, during operation of the VDE with one or more cylinders of the VDE deactivated, calculating a variation in a fast-sampled signal outputted by one or more exhaust gas oxygen (EGO) sensors of the VDE over a plurality of engine cycles; determining that the variation is greater than the threshold variation; and in response, indicating that valves of the one or more cylinders are not deactivated. A second method comprises estimating a throttle air flow rate and an engine air flow rate of the VDE; and indicating non-deactivated valves of one or more deactivated cylinders if the throttle air flow rate exceeds the engine air flow rate by a threshold.

19 Claims, 7 Drawing Sheets

(56) References Cited

U.S. PATENT DOCUMENTS

| | | | | |
|---|---|---|---|---|
| 2010/0175463 | A1* | 7/2010 | Doering | F02D 41/221 73/114.37 |
| 2012/0173122 | A1* | 7/2012 | Nishikiori | F02D 41/0087 701/103 |
| 2017/0299466 | A1* | 10/2017 | Chen | F02M 35/1038 |
| 2019/0249618 | A1* | 8/2019 | Dudar | F01L 13/0005 |
| 2019/0331032 | A1* | 10/2019 | McConville | F02D 13/06 |
| 2020/0191075 | A1* | 6/2020 | Szczepanski | F02D 13/06 |
| 2020/0191076 | A1* | 6/2020 | Szczepanski | F02D 41/1441 |

* cited by examiner

METHODS AND SYSTEMS FOR DIAGNOSING NON-DEACTIVATED VALVES OF DISABLED ENGINE CYLINDERS

FIELD

The present description relates generally to methods and systems for controlling a variable displacement engine (VDE) of a vehicle, and more specifically, to detecting non-deactivated intake and exhaust valves during operation of the engine in a VDE mode.

BACKGROUND/SUMMARY

Having all cylinders of the engine combust for low power loads may be inefficient, may degrade a fuel economy of the vehicle, and/or may increase emissions. When the engine is a variable displacement engine (VDE), one approach to increasing an efficiency of the engine includes deactivating one or more cylinders of the VDE during operation. VDEs may be configured to operate with a variable number of active or deactivated cylinders to increase fuel economy, while optionally maintaining the overall exhaust mixture air-fuel ratio about stoichiometry. This may be referred to as operating in a VDE mode. Typically, a control system selectively deactivates cylinders via adjustment of a plurality of cylinder valve deactivators, thereby sealing the deactivated cylinders by maintaining intake and exhaust valves of the deactivated cylinders closed, and the deactivated cylinders are not fueled.

A degradation or malfunction in the cylinder valve deactivators may prevent deactivation of at least one intake valve and at least one exhaust valve of a cylinder. In such a state, fresh oxygen is inducted into and exhausted from this cylinder, introducing fresh air into the exhaust. A closed loop fueling system may interpret this as a lean excursion, and respond by adding more fuel to still firing cylinders on a respective bank. When the added fuel meets fresh air in the exhaust, an exotherm event may be created.

Prior solutions to detecting non-deactivation of intake and exhaust valves in VDE mode involved measuring a mean air-fuel ratio (AFR) at a UEGO (universal or wide-range exhaust gas oxygen) sensor to determine if an extra cylinder's worth of fresh air could be detected in an exhaust stream. However, the inventors herein have recognized potential issues with this method. In particular, the method lacks robustness to noise factors that might cause the engine to be running lean overall. A lean running engine may naturally look like one or more valves of a cylinder have not been deactivated, when no degradations are present. As detecting non-deactivation of intake and exhaust valves is a regulatory requirement, a more robust diagnostic is needed.

In one example, the issue described above may be addressed by a method for a controller of a VDE, comprising, during operation of the VDE with one or more cylinders of the VDE deactivated, calculating a variation in a fast-sampled signal outputted by one or more exhaust gas oxygen (EGO) sensors of the VDE over a plurality of engine cycles; determining that the variation is greater than the threshold variation; and in response, indicating that at least one intake valve and at least one exhaust valve of the one or more cylinders are not deactivated. In another example, a method comprises, during a steady-state or quasi-steady operation of the VDE with one or more cylinders of the VDE deactivated, estimating a throttle air flow rate and an engine air flow rate of the VDE, and in response to the throttle air flow rate exceeding the engine air flow rate by a threshold, indicating that an intake valve and an exhaust valve of at least one of the one or more deactivated cylinders is not being held in a closed position. In response to an indication of a deactivated cylinder with non-deactivated valves, the controller may adjust engine operation, for example, by reactivating the one or more cylinders of the VDE to decrease an amount of emissions of the vehicle and/or increase an efficiency of the VDE. By basing a valve non-deactivation diagnostic routine on a comparison of the variation in EGO sensor output with a baseline variation and/or a comparison of an estimated engine air flow with a measured or estimated throttle air flow, rather than a mean AFR, an increase in emissions may be accurately attributed to a non-deactivated valve rather than a lean running engine.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for determining, for a variable displacement engine (VDE) running with one or more cylinders deactivated, whether valves of the one or more deactivated cylinders may not have been deactivated. During deactivation of a cylinder of the VDE, firing of the cylinder may be deactivated and lifting of an intake valve and an exhaust valve may be deactivated, whereby the cylinder does not fire and the intake valve and the exhaust valve are both maintained closed during operation of the VDE. Other cylinders of the VDE may continue to fire. However, under some circumstances, such as when a degradation occurs in a valve deactivation mechanism, firing of a cylinder may be deactivated (also referred to herein as deactivating the cylinder) and the intake valve and exhaust valve of the cylinder may not be deactivated. When one or more intake and exhaust valves of a non-firing cylinder continue to lift during operation of the VDE, oxygen may be released into exhaust gases. As a result of detecting an increased amount of oxygen, a controller of the VDE may adjust an air-fuel ratio (AFR) of the VDE to a richer mixture, which may negatively impact fuel efficiency, vehicle performance, and emissions released into the atmosphere. To address this issue, methods and systems are proposed herein to efficiently check (e.g., after deactivation of a cylinder) whether an intake valve and an exhaust valve of a deactivated cylinder that are commanded to a closed position are continuing to lift and are not being maintained in the closed position.

Figure 1:
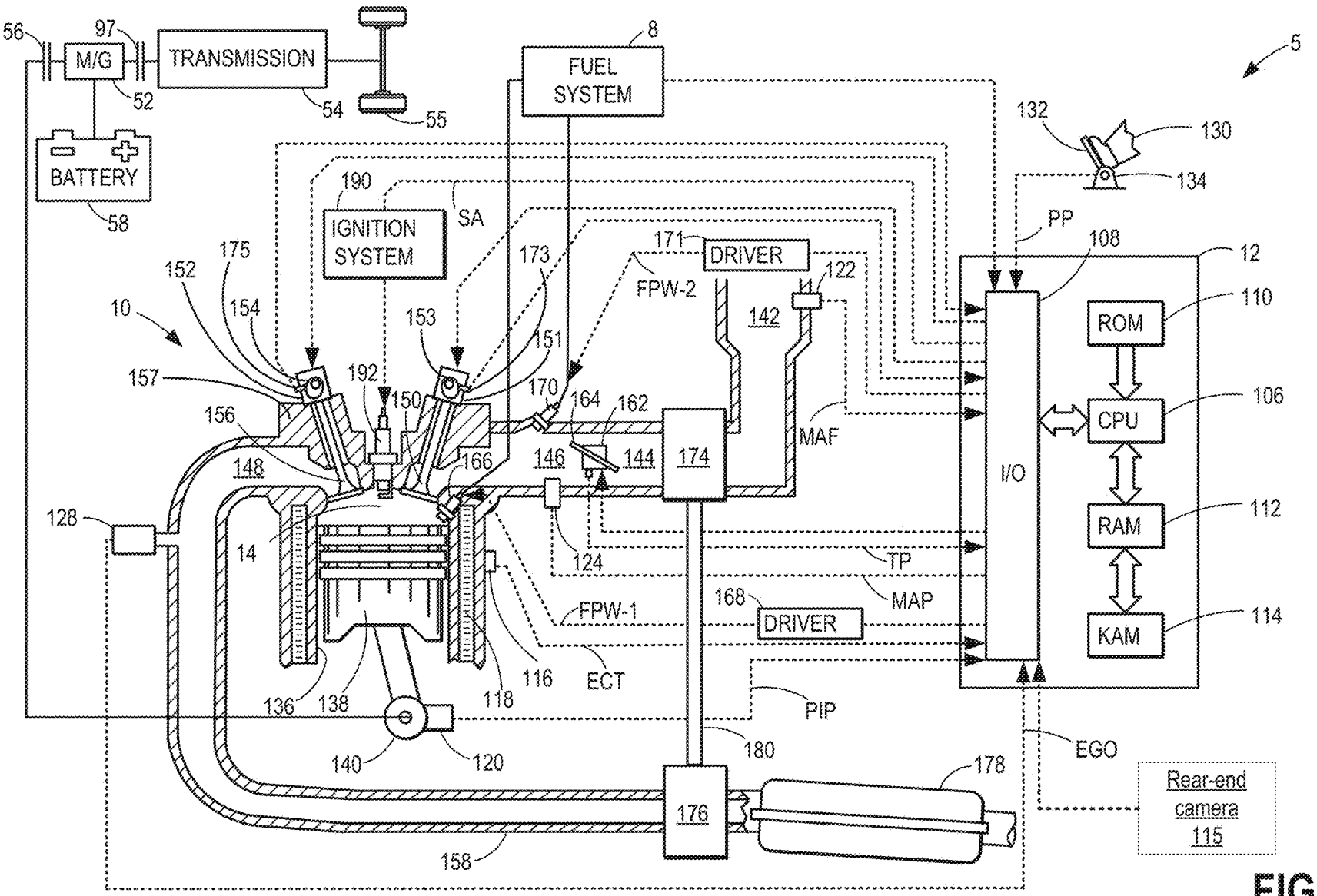
FIG. 1 schematically shows a variable displacement engine including a combustion chamber having intake valves and/or exhaust valves driven via camshaft.
Figure 2:
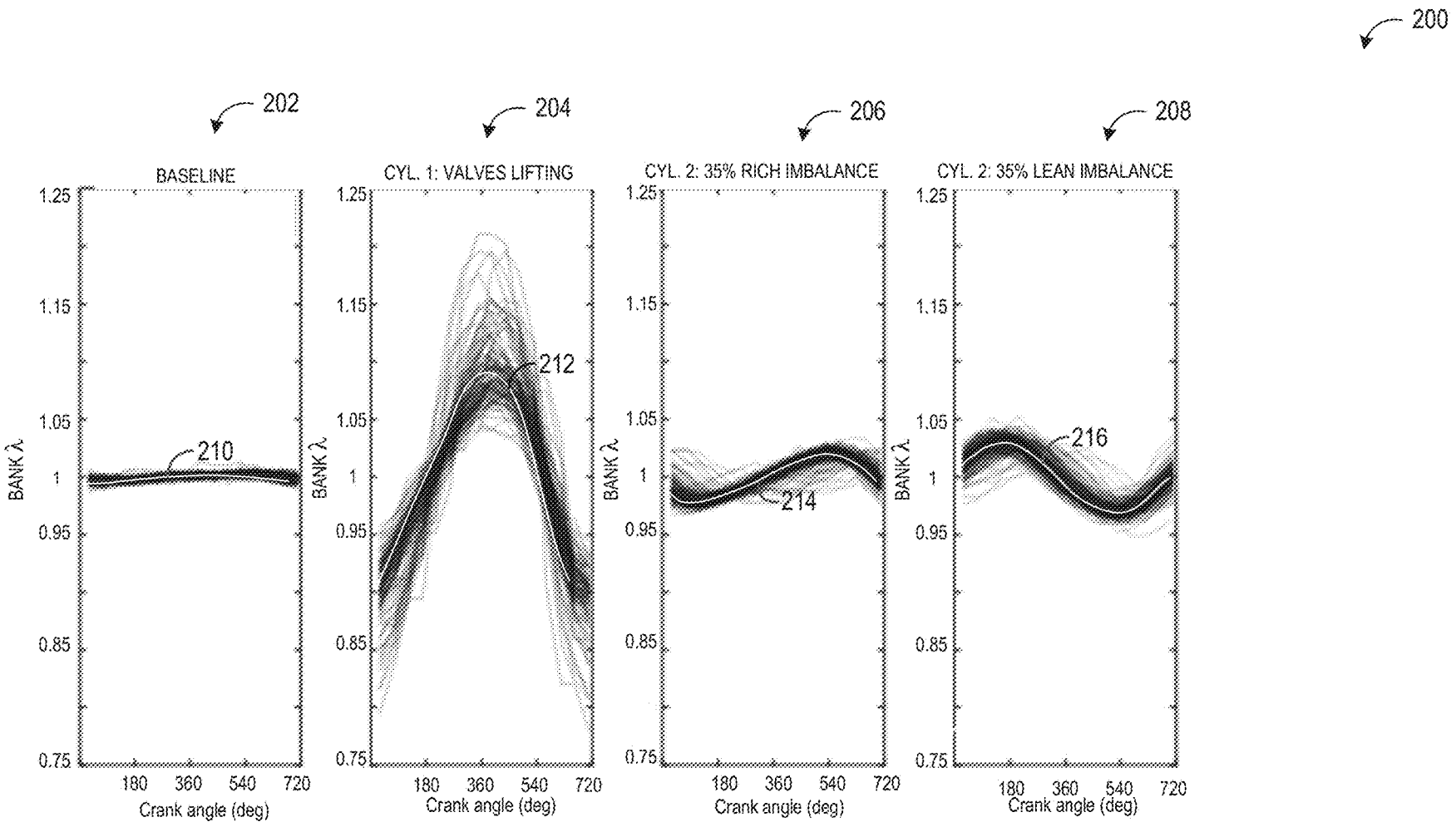
FIG. 2 shows a first set of example fast-sampled λ traces from a plurality of engine cycles of a bank of a V8 VDE, where λ is the ratio of an AFR to stoichiometry based on signal received from an EGO sensor of the VDE.
Figure 3:
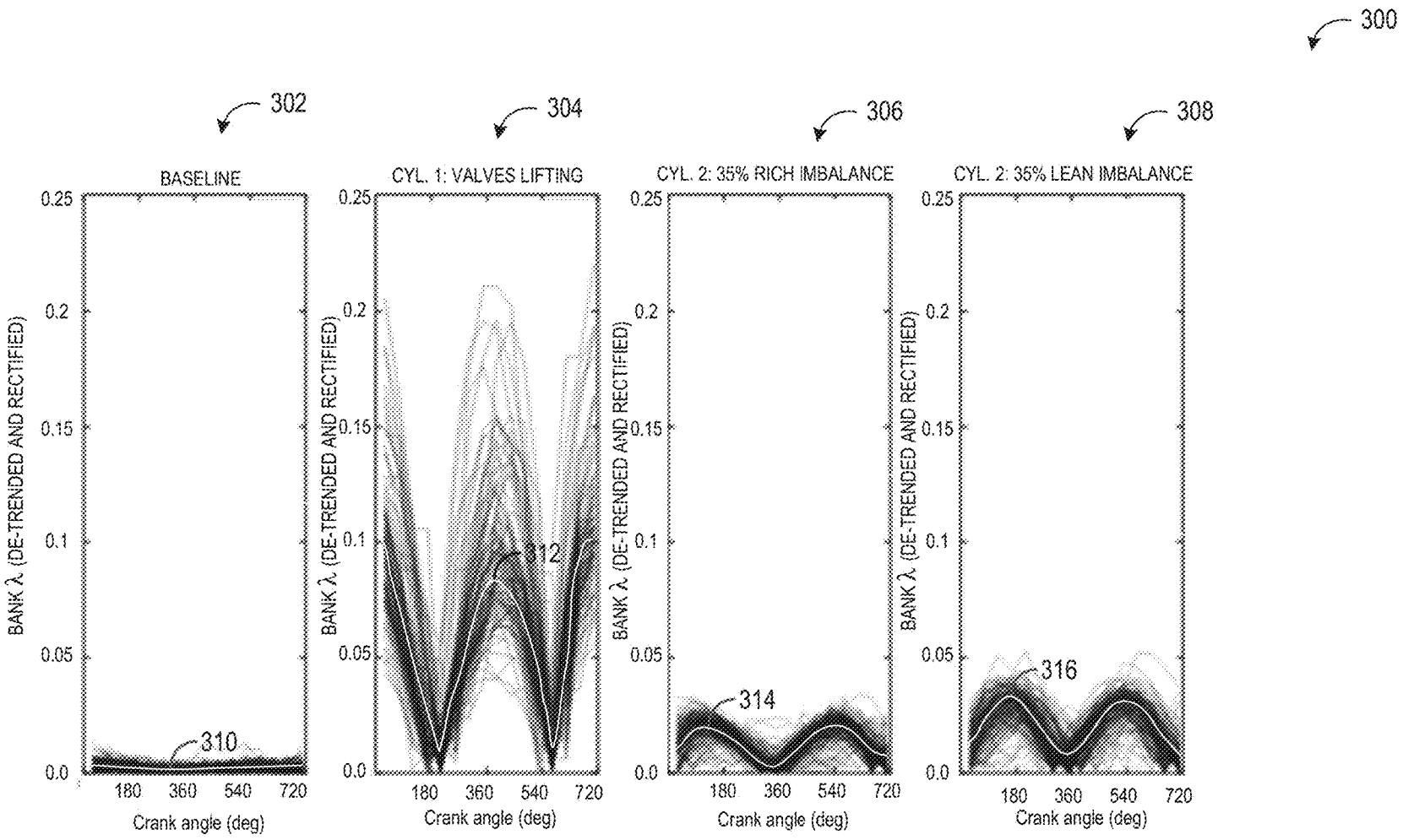
FIG. 3 shows a second set of example λ traces, where the λ traces of FIG. 2 have been de-trended and rectified in accordance with an algorithm.
Figure 4:
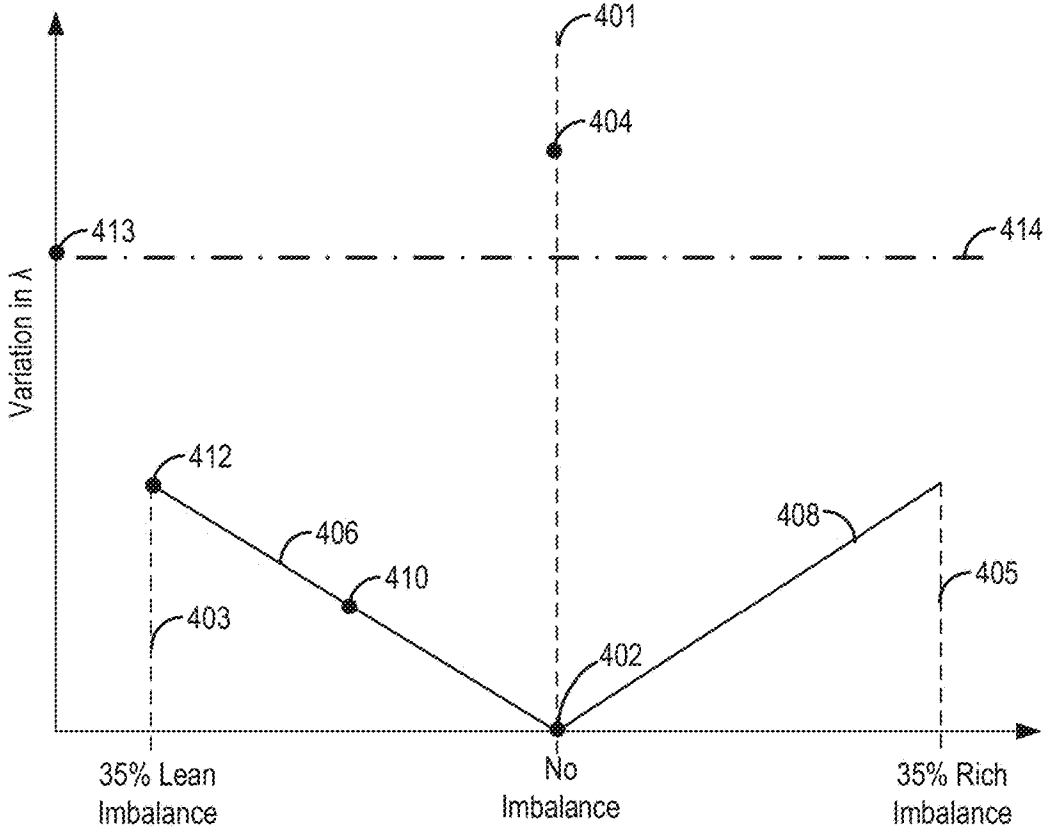
FIG. 4 is a graph comparing an example variation in λ generated by a non-deactivated intake/exhaust valve with a plot of λ variations generated by a lean or rich air-fuel ratio of a VDE.

FIG. 1 depicts an example of a combustion chamber or cylinder of an internal combustion engine of a vehicle, where the internal combustion engine is a VDE. When one or more cylinders of the VDE are deactivated, if an actuation mechanism for deactivating cylinder valves is degraded, an exhaust valve and an intake valve of a deactivated cylinder may not be deactivated and may continue to lift. A non-deactivated valve may be detected by comparing a variation in a signal from an EGO sensor (e.g., a variation in λ, a value generated from the signal) with a baseline variation or a variation caused by an AFR imbalance, as shown in FIG. 4. Example traces of variations in λ over a plurality of engine cycles that are attributable to non-deactivated valves and AFR imbalances are shown in FIG. 2. Differences in the signal variations may be easier to detect if the λ variation traces are de-trended, as shown in FIG. 3. An algorithm for determining whether a valve of a deactivated cylinder has not been deactivated may be based on a first method 500 of FIG. 5, which relies on determining whether λ variation is above a threshold variation, or a second method 700 of FIG. 7, which relies on comparing a throttle air flow of the VDE with an estimated engine air flow. The threshold variation described in method 500 may be calculated by following one or more steps of method 600 of FIG. 6.

Referring to FIG. 1, an example of a combustion chamber or cylinder of internal combustion engine 10 is shown. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. The cylinder 14 is capped by cylinder head 157. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the air flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state exhaust gas oxygen sensor or EGO (as depicted), a HEGO (heated EGO), a NOx, HC, or CO sensor, for example. Emission control device 178 may include a three-way catalytic converter, where a three way catalyst (TWC) is used to oxidize exhaust gas pollutants, NOx trap, or other similar emission control devices, or combinations thereof.

In the depicted embodiment, sensor 128 is an EGO sensor configured to indicate a relative enrichment or leanness of the exhaust gas prior to passing through the emission control device 178. For example, an output voltage of the EGO sensors may be a nonlinear function of an amount of oxygen present in the exhaust gas, with a lean feed resulting in a relatively low EGO sensor voltage and a rich feed resulting in a relatively high EGO sensor voltage.

Each cylinder of engine 10 includes one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

In the example of FIG. 1, intake valve 150 and exhaust valve 156 are actuated (e.g., opened and closed) via respective cam actuation systems 153 and 154. Cam actuation systems 153 and 154 each include one or more cams mounted on one or more camshafts and may utilize one or more of cam profile switching (CPS), variable cam timing (VCT), variable valve timing (VVT) and/or variable valve lift (VVL) systems that may be operated by controller 12 to vary valve operation. The angular position of intake and exhaust camshafts may be determined by position sensors 173 and 175, respectively. In alternate embodiments, one or more additional intake valves and/or exhaust valves of cylinder 14 may be controlled via electric valve actuation. For example, cylinder 14 may include one or more additional intake valves controlled via electric valve actuation and one or more additional exhaust valves controlled via electric valve actuation. It should be appreciated that the actuation systems described herein are for illustrative purposes, and in other examples, the internal combustion engine 10 may include one or more different cam actuation systems.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 housed within cylinder head 157 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. In some embodiments, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics, such as differences in size. For example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches are engaged. In the depicted example, a first clutch 56 is provided between crankshaft 140 and electric machine 52, and a second clutch 97 is provided between electric machine 52 and transmission 54. Controller 12 may send a signal to an actuator of each clutch (e.g., first clutch 56 and/or second clutch 97) to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

As described above, FIG. 1 shows only one cylinder of multi-cylinder engine 10. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Engine 10 is a VDE (also referred to herein as VDE 10), and cylinder 14 may be one of a plurality of deactivatable or non-deactivatable cylinders of VDE 10. For example, one or more valves of cylinder 14 (e.g., intake valve 150 and/or exhaust valve 156) may be adjustable by controller 12 from an activated mode to a deactivated mode (and vice versa). For example, cylinder 14 may be a deactivatable cylinder, with intake valve 150 and exhaust valve 156 each being coupled to respective deactivatable valve assemblies. The deactivatable valve assemblies may be deactivatable via a suitable type of deactivation device, such as via lash adjustment, rocker arm deactivation, roller lifter deactivation, camshaft-type deactivation, etc. In some examples the deactivatable valve assemblies may adjust an operational mode of their corresponding coupled valves in response to signals transmitted to the deactivatable valve assemblies by controller 12. Intake valve 150 is shown coupled to deactivatable valve assembly 151 and exhaust valve 156 is shown coupled to deactivatable valve assembly 152.

In one example, controller 12 may transmit electrical signals to deactivatable valve assembly 151 in order to adjust the operational mode of intake valve 150 from an activated mode to a deactivated mode (or vice versa) and/or controller 12 may transmit electrical signals to deactivatable valve assembly 152 in order to adjust the operational mode of exhaust valve 156 from an activated mode to a deactivated mode (or vice versa).

Although operation of cylinder 14 is adjusted via deactivatable valve assemblies 151 and 152 as described above, in some examples, operation of one or more cylinders of VDE 10 may not be adjusted by deactivatable valve assemblies. For example, VDE 10 may include four cylinders (e.g., cylinder 14), with operation of a first pair of the cylinders being adjustable via deactivatable valve assemblies and operation of a second pair of cylinders not being adjustable via deactivatable valve assemblies.

VDE 10 may be designed to deactivate cylinders en masse, where more than one cylinder may be deactivated at the same time. For example, two cylinders of VDE 10 may be deactivated, leaving six cylinders of VDE 10 combusting fuel and two cylinders operating unfueled. VDE 10 may also be designed as a rolling VDE system where each cylinder may be turned off individually. For example, a first cylinder of VDE 10 may be deactivated responsive to a first condition, a second cylinder of VDE 10 may be deactivated responsive to a second condition, a third cylinder of VDE 10 may be deactivated responsive to a third condition, and so on. Similarly, VDE 10 may be designed to activate one or more cylinders, either en masse or individually, during operation of VDE 10 and/or upon startup of VDE 10. In one example, VDE 10 may be switched on in an initial configuration of activated and deactivated cylinders.

During a selected condition, such as when the full torque capability of the engine is not requested, one or more cylinders of VDE 10 may be deactivated (herein also referred to as a VDE mode of operation). For example, upon the selected condition being met, a cylinder 1 of VDE 10 may be deactivated, or a cylinder 2 of VDE may be deactivated, or a cylinder 3 of VDE 10 may be deactivated, and so on. Additionally, one of a first or a second cylinder group may be selected for deactivation. For example, the first cylinder group may comprise the cylinder 1, a cylinder 4, a cylinder 6, and a cylinder 7, and the second cylinder group may comprise the cylinder 2, a cylinder 3, a cylinder 5, and a cylinder 8. In another example, the first cylinder group may comprise the cylinders of a first bank, and the second cylinder group may comprise the cylinders of a second bank. Thus, any number of cylinders of VDE 10 may be activated or deactivated, individually or in groups, in various configurations. Each configuration of the various configurations may generate an engine torque, where the engine torque of one configuration may or may not be the same as the engine torque of a different configuration. By adjusting the configuration of activated and deactivated cylinders, the engine torque may be increased or decreased.

During the VDE mode, cylinders of the selected group of cylinders may be deactivated by shutting off respective fuel injectors and deactivating respective intake and exhaust valves. While fuel injectors of the disabled cylinders are turned off, the remaining enabled cylinders continue to carry out combustion, with corresponding fuel injectors and intake and exhaust valves active and operating. To meet torque requirements, the engine may produce the same amount of torque on active cylinders as was produced with all cylinders firing. This requires higher manifold pressures, resulting in lowered pumping losses and increased engine efficiency. Additionally, the lower effective surface area (from the enabled cylinders and not the disabled cylinders) exposed to combustion reduces engine heat losses, improving the thermal efficiency of the engine.

The controller 12 receives signals from the various sensors of FIG. 1 and employs the various actuators of FIG. 1 to adjust engine operation based on the received signals and instructions stored on a memory of the controller. For example, adjusting the intake valve 150 from the activated mode to the deactivated mode may include adjusting an actuator of the intake valve 150 (e.g., deactivatable valve assembly 151) to adjust an amount of movement of the intake valve 150 relative to cylinder 14. For example, the controller 12 may transmit electrical signals to a hydraulic fluid valve of the deactivatable valve assembly 151 (with the deactivatable valve assembly 151 coupled to the intake valve 150) in order to move the hydraulic fluid valve of the deactivatable valve assembly 151 from the closed position to an opened position. Similarly, the controller 12 may transmit electrical signals to the hydraulic fluid valve of the deactivatable valve assembly 151 in order to move the hydraulic fluid valve to an opened position and thereby adjust the intake valve 150 to the activated mode.

Controller 12 is shown in FIG. 1 as a microcomputer, including microprocessor unit 106, input/output ports 108, an electronic storage medium for executable programs and calibration values shown as non-transitory read-only memory chip 110 in this particular example for storing executable instructions, random access memory 112, keep alive memory 114, and a data bus. As discussed herein, memory includes any non-transient computer readable medium in which programming instructions are stored. For the purposes of this disclosure, the term tangible computer readable medium is expressly defined to include any type of computer readable storage. The example methods and systems may be implemented using coded instruction (e.g., computer readable instructions) stored on a non-transient computer readable medium such as a flash memory, a read-only memory (ROM), a random-access memory (RAM), a cache, or any other storage media in which information is stored for any duration (e.g. for extended period time periods, permanently, brief instances, for temporarily buffering, and/or for caching of the information). Computer memory of computer readable storage mediums as referenced herein may include volatile and non-volatile or removable and non-removable media for a storage of electronic-formatted information such as computer readable program instructions or modules of computer readable program instructions, data, etc. that may be stand-alone or as part of a computing device. Examples of computer memory may include any other medium which can be used to store the desired electronic format of information and which can be accessed by the processor or processors or at least a portion of a computing device.

Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature.

In the event of a degradation or malfunction in one or more of the actuation mechanisms for deactivating valves of a disabled cylinder (e.g., deactivatable valve assemblies 151 and 152), a situation may occur in which intake valve 150 and/or exhaust valve 156 continue to lift during operation of the VDE when the disabled cylinder is not firing. For example, a malfunction may occur in an hydraulic control valve, locking pin, or different component of the actuation mechanisms. When this happens, fresh air may be inducted into the deactivated cylinder and introduced into the exhaust. In response to an exhaust gas oxygen sensor (e.g., sensor 128) detecting an increase in oxygen in the exhaust, controller 12 may increase an amount of fuel injected into other cylinders of a relevant cylinder bank of VDE 10. The injection of additional fuel may waste energy, reduce engine efficiency, and generate emissions in excess of regulatory requirements.

One solution to the problem described above that may be more effective than relying on an average AFR during an engine cycle involves measuring a variation in an EGO signal (e.g., a variation in λ, where λ is the ratio of the AFR to stoichiometry based on the EGO signal), as disclosed herein. The effect of a deactivated cylinder whose valves continue to lift may be clearly detectable in a fast-sampled EGO signal. If a deactivated cylinder is still inducting, a sharp increase in the EGO signal (λ) may be detected, but for a short period (e.g., during a fraction of an engine cycle) when its exhausted fresh air charge reaches the EGO sensor. The sharp increase in λ may be significantly greater than its corresponding bias introduced to the (cycle) averaged λ. Therefore, it may be easier to differentiate from biases due to broad band tendencies for the engine to be running lean. Alternatively, a throttle air flow measurement or estimate of VDE 10 may be compared to an engine air flow estimate of VDE 10. To ensure that non-deactivated valves of disabled cylinders are detected and repaired or replaced, controller 12 may carry out one or more valve deactivation diagnostic routines that rely on such solutions, as described below in reference to FIGS. 5, 6, and 7.

FIG. 2 shows fast-sampled λ traces (black lines) from a plurality of engine cycles from a right bank of a V8 operating in VDE mode, where cylinders 1 & 4 are deactivated, and cylinders 2 & 3 are firing. The mean traces (white lines) show trends of the individual traces. A first plot 202 shows a baseline case under normal operating conditions with no degradations and a balanced AFR, with a trend line 210 indicating the trend in the baseline case. For the purposes of this disclosure, a balanced AFR may refer to a nominal expected AFR imbalance of less than 5% or 7%, due to part-to-part variation. A second plot 204 shows λ traces produced as a result of intake and exhaust valves of a deactivated cylinder 1 not being deactivated and continuing to lift, with a trend line 212 indicating the trend in the non-deactivated valve case. A third plot 206 and corresponding trend line 214 show λ traces corresponding to an AFR imbalance in cylinder 2 where valves are correctly deactivated, but the AFR of the (firing) cylinder 2 is 35% richer than the AFR of the (firing) cylinder 3. Similarly, a fourth plot 208 and corresponding trend line 216 show λ traces corresponding to an AFR imbalance in cylinder 2 where valves are correctly deactivated, but the AFR of the (firing) cylinder 2 is 35% leaner than the AFR of the (firing) cylinder 3.

In plot 202, trend line 210 indicates that the λ traces are approximately flat, since exhaust pulses from the firing cylinders (2 & 3) have similar λ≈1. Thus, under normal operating conditions with a balanced AFR and valve deactivation working properly a minor variation in λ is expected.

In contrast, in plot 204, trend line 212 shows a sharp λ increase due to the fresh air charge from cylinder 1. This sharp λ increase is easily distinguishable from the λ increase due to large AFR imbalances shown in trend lines 214 and 216 of plots 206 and 208, respectively. Even a large AFR imbalance of 35% (richer or leaner) does not result in a variation in λ as large as that seen in plot 204. Thus, a measurement of the variation in λ during each engine cycle may be used by a valve deactivation diagnostic routine as an indicator of proper valve deactivation. The baseline case with the balanced AFR shown in plot 202 has very little variation; an AFR imbalance as shown in plots 206 and 208 have a moderate variation; and non-deactivated valves result in a large variation. It should be appreciated that while the baseline variations in λ are expected to span a range of values across different individual engines of the same type or design, an upper limit of the range of values would still be smaller than variations in λ due to an AFR imbalance due to a malfunction, such as a clogged fuel injetor (e.g., 25% or 35%). A diagnostic routine to detect non-deactivated valves could compute a metric indicative of a variation in fast-sampled λ and compare it to a threshold variation. The threshold variation may be higher than the metric values corresponding to the baseline variation and AFR imbalance cases, but lower than the metric values corresponding to non-deactivated valves of a VDE. Various metrics may be used.

FIG. 3 shows one metric, where the λ traces from FIG. 2 have been de-trended, rectified (e.g., by taking an absolute value), and refined by averaging across a plurality of engine cycles. A first plot 302 shows a baseline case for a de-trended and rectified λ under normal operating conditions with no degradations and a balanced AFR, with a trend line 310 indicating the trend in the baseline case. A second plot 304 shows de-trended and rectified λ traces produced as a result of intake and exhaust valves of a deactivated cylinder 1 not being deactivated and continuing to lift, with a trend line 312 indicating the trend in the non-deactivated valve case. A third plot 306 and corresponding trend line 314 show de-trended and rectified λ traces corresponding to an AFR imbalance in cylinder 2 where valves are correctly deactivated, but the AFR of the (firing) cylinder 2 is 35% richer than the AFR of the (firing) cylinder 3. Similarly, a fourth plot 308 and corresponding trend line 316 show de-trended and rectified λ traces corresponding to an AFR imbalance in cylinder 2 where valves are correctly deactivated, but the AFR of the (firing) cylinder 2 is 35% leaner than the AFR of the (firing) cylinder 3.

In a first step, the fast-sampled λ signal may be de-trended. In one embodiment, this may be achieved using a first-in first-out (FIFO) buffer of λ samples spanning one engine cycle, where the de-trended λ may then be computed by subtracting the median λ (middle buffer element minus median λ of the buffer elements) or subtracting the mean λ (middle buffer element minus mean λ of the buffer elements). The de-trended λ value can then be rectified by taking the absolute value, then averaging or summing over a predetermined number of engine cycles to obtain a metric or measure of variation in λ. In some cases, the diagnostic may rely on multiple evaluations of such metric to increase accuracy. De-trending and rectifying the λ samples is described in greater detail below in reference to FIG. 5.

Figure 5:
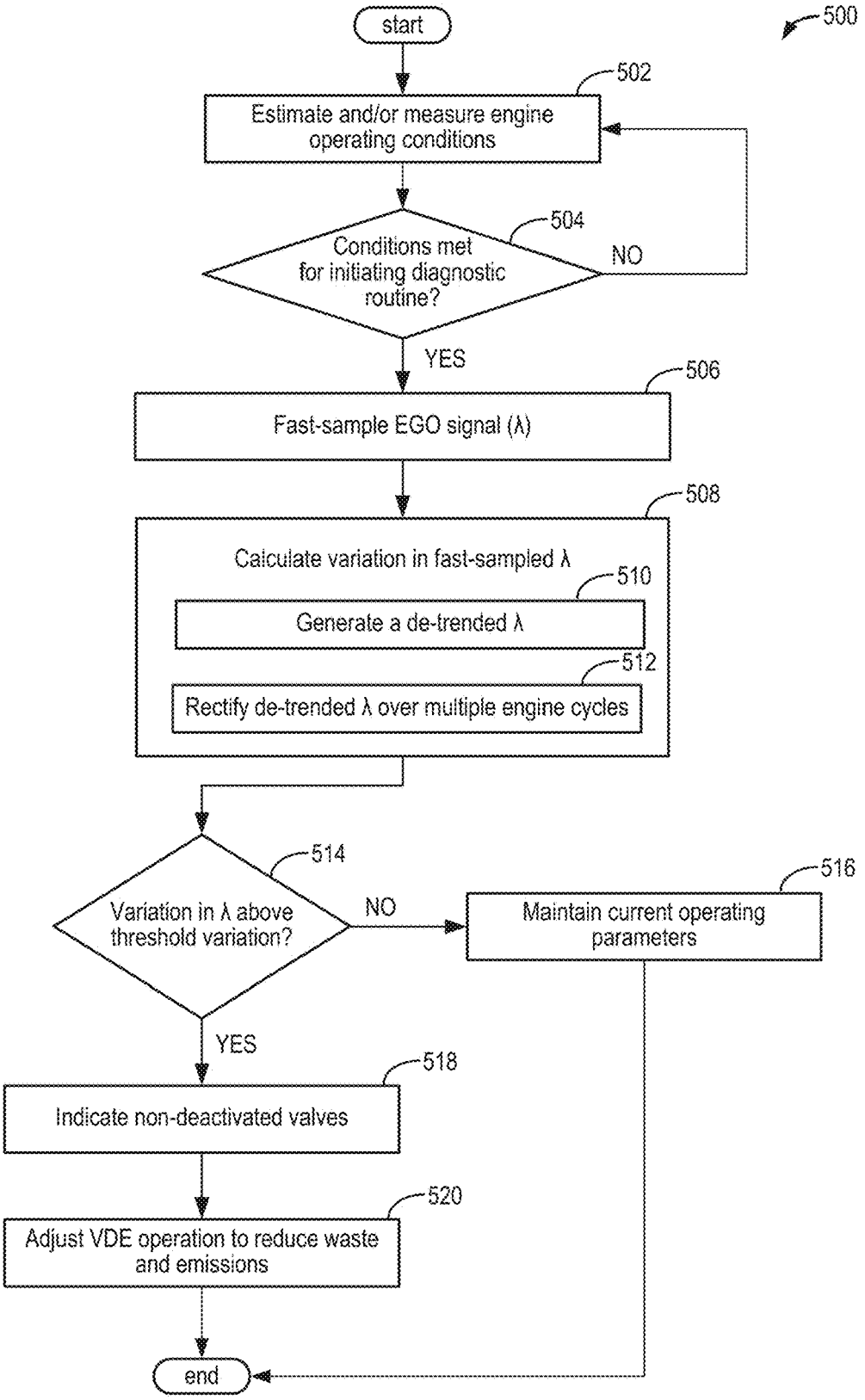
FIG. 5 shows a flow chart illustrating a first exemplary method for detecting a non-deactivated valve of a VDE.

Referring now to FIG. 5, an exemplary method 500 is shown for detecting non-deactivated intake and exhaust valves of a deactivated cylinder of a VDE, as part of a valve deactivation diagnostic routine of the VDE. Instructions for carrying out method 500 and the rest of the methods included herein may be executed by a controller (e.g., the controller 12 of FIG. 1) based on instructions stored on a memory of the controller and in conjunction with signals received from sensors of an engine system of the vehicle, such as the sensors described above with reference to FIG. 1. The controller may employ engine actuators of the engine system to adjust operation of an engine of the vehicle, according to the methods described below.

At 502, method 500 includes estimating and/or measuring engine operating conditions. Estimating and/or measuring operating conditions may include, but are not limited to, determining whether the vehicle is being powered by an engine or an electric motor, a status of the engine (e.g., determining whether a VDE of the vehicle is switched on, and how many cylinders of the VDE are firing), an AFR of fuel delivered at the cylinders of the VDE, and a status of one or more diagnostic routines operating in the engine system or exhaust system. Engine operating conditions may be estimated based on one or more outputs of various sensors of the VDE or corresponding vehicle, such as oil temperature sensors, engine velocity or wheel velocity sensors, torque sensors, etc., as described above in reference to vehicle 5 of FIG. 1. Engine operating conditions may include engine velocity and load, vehicle velocity, transmission oil temperature, exhaust gas flow rate, mass air flow rate, coolant temperature, coolant flow rate, engine oil pressures (e.g., oil gallery pressures), operating modes of one or more intake valves and/or exhaust valves, electric motor velocity, battery charge, engine torque output, vehicle wheel torque, etc.

At 504, method 500 includes determining whether conditions have been met for initiating the valve deactivation diagnostic routine. Conditions for initiating the valve deactivation diagnostic routine may include, for example, the VDE operating with one or more cylinders of the VDE deactivated (e.g., in a VDE mode), and a detection of higher-than-normal levels of oxygen in an exhaust gas of the VDE as measured by one or more EGO sensors (e.g., sensor 128 of FIG. 1). For example, if an increase in exhaust gas oxygen above a threshold is detected by a controller of the VDE based on an output from an EGO sensor of a cylinder of the VDE, the valve deactivation diagnostic routine may be initiated, and if an increase in the exhaust gas oxygen is not detected or if the increase in exhaust gas oxygen does not exceed the threshold, the valve deactivation diagnostic routine may not be initiated. In some embodiments, the valve deactivation diagnostic routine may be carried out at predetermined times, such as after a deactivation of one or more cylinders of the VDE, or in response to other sensor data available to the controller. Alternatively, the valve deactivation diagnostic routine may be carried out when operating in a speed/load region where the diagnostic routine has a good signal to noise ratio. For example, a transient response of the EGO sensor may be slow at low engine air flow rates (e.g. low engine torque conditions), resulting in a suboptimal signal to noise ratio. The diagnostic routine may have an engine speed/load or engine speed/torque-based enablement grid, such that the diagnostic routine is executed in operating regions with sufficient signal to noise ratio.

In some embodiments, the diagnostic routine may be carried out when the engine is operating in quasi-steady conditions, for example, when a rate of change in engine speed is below a first threshold and a rate of change in engine load is below a second threshold. By carrying out the diagnostic routine under quasi-steady conditions, false detections due to larger variations in λ resulting from transient fueling errors may be averted.

If at 504 it is determined that conditions have not been met for initiating the valve deactivation diagnostic routine, method 500 proceeds back to 502 until the conditions are met. If at 504 it is determined that conditions have been met for initiating the valve deactivation diagnostic routine, method 500 proceeds to 506.

At 506, method 500 includes fast-sampling a signal generated by one or more EGO sensors arranged on an exhaust passage of one or more cylinder banks of the VDE during various engine cycles. For example, the VDE may be a V-8 operating in a VDE mode with a first, left bank of four cylinders and a second, right bank of four cylinders, where two of the four cylinders of the left bank have been deactivated and two of the four cylinders of the right bank have been deactivated. Upon initiation of the valve deactivation diagnostic routine, signals may be fast-sampled from a first EGO sensor arranged on an exhaust passage of the left bank and a second EGO sensor arranged on an exhaust passage of the right bank. In some embodiments the EGO sensor may be a UEGO sensor, or a HEGO sensor, or a different kind of exhaust gas oxygen sensor.

As described herein, fast-sampling the signal may refer to sampling the signal at a rate that is at least twice a firing rate of activated cylinders sharing a same EGO/UEGO sensor. The fast sampling should satisfy the Nyquist criterion, whereby the sampling frequency should be at least twice the highest frequency content of the λ signal. For example, for a cross-plane crankshaft V8 operating as a V4 in VDE mode with a firing frequency 4 times the engine cycle frequency with same bank cylinders firing a quarter cycle apart, the sampling rate should be at least 8 times the engine cycle frequency. In practice, it may be desirable to set the sampling rate higher than a theoretical minimum sampling frequency (e.g. 5 times the highest frequency content of the λ signal, rather than twice the highest frequency content).

In some embodiments, a cycle-based sampling rate (e.g. 8 or 16 samples per engine cycle) maybe be used, where the time-based sampling frequency increases linearly with engine speed. Alternatively, a fixed time-based frequency may be used such that the Nyquist criterion is met at the highest engine speed at which the diagnostic routine may be executed. For example, at 4000 RPM, 8 samples per cycle corresponds to 266.67 Hz. If VDE mode and the diagnostic routine may not be enabled above 4000 RPM, a fixed (time-based) sampling frequency of 266.67 Hz may be used. In this way, the corresponding cycle-based sampling rate is at least 8 samples per cycle (e.g. 8 samples per cycle at 4000 RPM, 16 samples per cycle at 2000 RPM, etc.).

At 508, method 500 includes calculating a variation in the fast-sampled EGO signals (λ) outputted by each EGO sensor of the VDE. For example, in a VDE with eight cylinders on two banks, independent λ variations may be calculated for a first EGO sensor of a first bank, which may be used to determine whether valves at one or more cylinders of the first bank have not deactivated, and a second EGO sensor of a second bank, which may be used to determine whether valves at one or more cylinders of the second bank have not deactivated.

At 510, calculating the variation in the fast-sampled λ at each EGO sensor may include generating a de-trended λ during a single engine cycle. In some embodiments, generating a de-trended λ may include collecting a plurality of λ samples in a first-and-first-out (FIFO) buffer, and then computing a de-trended λ via a statistical operation. For example, the statistical operation may include subtracting a median λ of the plurality of λ samples from a λ located at the middle buffer element of the FIFO buffer to generate the de-trended λ. In other embodiments, a different method to generate a de-trended λ may be used. For example, in some embodiments, the mean λ (instead of median λ) of the plurality of λ samples maybe subtracted from a λ sample at the middle buffer element of the FIFO buffer to generate the de-trended λ. In yet another embodiment, the λ signal may be high-pass filtered (e.g., using a Finite Impulse Response (FIR) or Infinite Impulse Response (IIR) high-pass filter) to generate the de-trended λ. A band-pass filter may be used in yet other embodiments.

At 512, the de-trended λ value may then be rectified by averaging or summing the absolute value of the de-trended λ value over a predetermined number (e.g., 25, 100, or 250) of engine cycles to obtain a metric or measure of variation in λ. In some embodiments, a square function may be used instead of an absolute value function. The valve deactivation diagnostic routine may include making multiple evaluations of such a metric to increase accuracy.

In other embodiments, a different metric or measure of variation in λ may be used. For example, in some embodiments, steps 510 and 512 may be replaced by calculating a standard deviation or variance of the fast-sampled λ, or by measuring an amplitude or peak-to-peak amplitude of the fast-sampled λ, or by computing a magnitude of frequency components of the fast-sampled λ at engine-cycle frequency or an integer multiple of engine-cycle frequency. In still other embodiments, steps 510 and 512 may be replaced by numerically computing an absolute value of a derivative of the fast-sampled λ which is then averaged or summed over multiple engine cycles.

At 514, method 500 includes determining whether the variation in λ is greater than a threshold variation value. Calculation of the threshold variation value is described in greater detail below in reference to FIG. 6.

If at 514 it is determined that the variation in λ does not exceed the threshold variation, method 500 proceeds to 516. At 516, method 500 includes maintaining current operating parameters of the VDE, and method 500 ends. Alternatively, if at 514 it is determined that the variation in λ exceeds the threshold variation, method 500 proceeds to 518. At 518, method 500 includes indicating non-deactivated valves at one or more cylinders of the VDE or respective cylinder bank of the VDE.

At 520, in response to detecting non-deactivated valves at the one or more cylinders, method 500 includes adjusting an operation of the VDE to correct for any fuel wasted, excess energy produced, or emissions generated by the one or more cylinders with the non-deactivated valves. In various embodiments, the different cylinders may be selectively activated, and/or deactivated. In other embodiments, engine operation may be adjusted in a different manner to compensate for the fuel wasted, excess energy produced, or emissions generated as a result of the non-deactivated valves (e.g., a disable VDE mode). A malfunction indicator light (MIL) may also be set to signal to the driver a recommendation to service the vehicle. Method 500 ends.

Figure 6:
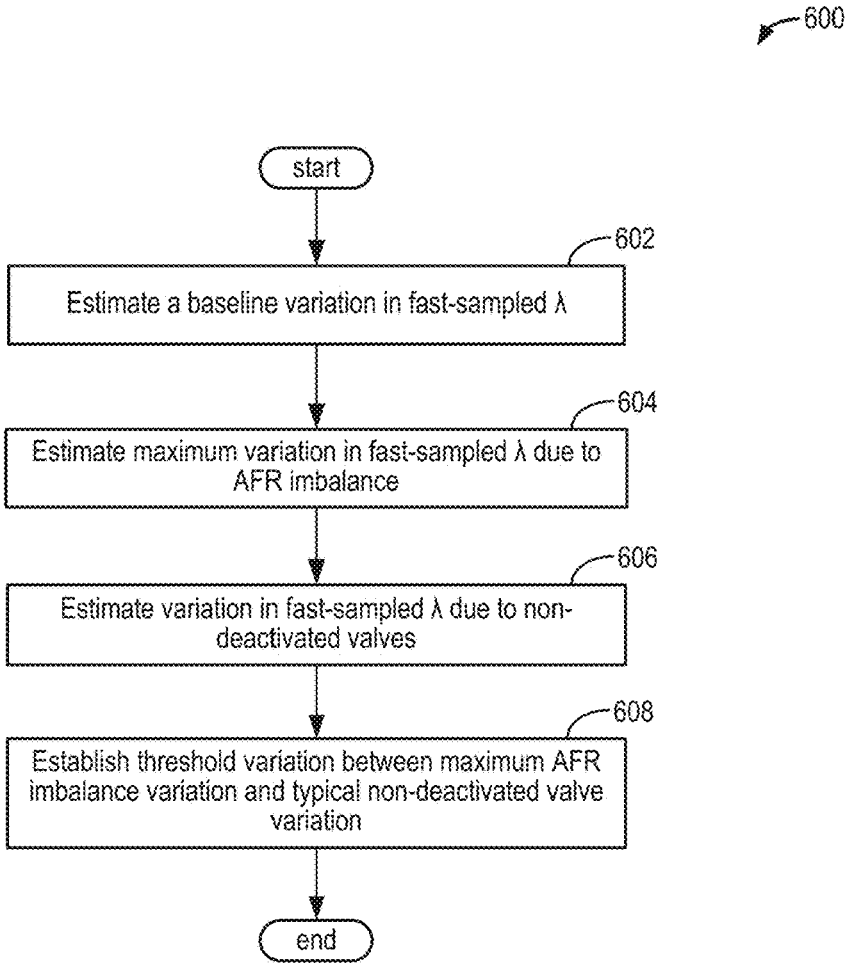
FIG. 6 shows a flow chart illustrating an exemplary method for setting a threshold variation in λ used in the method of FIG. 5.

Referring to FIG. 6, an exemplary method 600 for calculating the threshold variation of the diagnostic routine of method 500 is shown. Instructions for carrying out method 600 may be executed by a controller as described above in reference to method 500, or alternatively, one or more instructions may be carried out by a manufacturer based on compiled research and/or historical data of the VDE in different operating environments. In some embodiments, a single threshold variation may be established for each type of VDE, while in other embodiments, individual threshold variations may be calculated for each individual VDE based on operational data of the VDE.

Method 600 begins at 602, where method 600 includes estimating a baseline variation in the fast-sampled λ collected as described above in reference to method 500. In various embodiments, the baseline variation may be average of variations in the fast-sampled λ generated based on signals outputted by one or more EGO sensors of the VDE, over a plurality of engine cycles. For example, the baseline variation may be calculated by averaging variation in λ over 100 or 250 engine cycles for each engine speed and engine load combination from an engine speed and load grid where the VDE mode may be enabled and the diagnostic routine may be executed. A mapping of the baseline variation may also be based on (in addition to engine speed and load) a cylinder activation/deactivation pattern, in cases where more than one is possible. A single mapping of the baseline variation may be completed offline during an engine calibration process using a nominal engine operating in VDE mode with deactivated intake and exhaust valves and a largest possible nominal AFR imbalance (e.g., 5% or 7%) expected due to part-to-part variation. The single mapping of the baseline variation may be used on all individual engines of the same type for the diagnostic routine. In other embodiments, the mapping of the baseline variation may be performed (online) for each individual engine (e.g., during an early stage of engine VDE operation then saved to be used at a later stage for the diagnostic).

At 604, method 600 includes estimating a highest probable variation in λ attributable to an AFR imbalance (e.g., an AFR imbalance resulting in excessive emissions that violate a regulatory requirement). The estimated variation in λ attributable to an AFR imbalance may be based on lookup tables (e.g., as a function of engine speed and load) obtained offline during the calibration process. In various embodiments, the highest probable variation attributable to an AFR imbalance may be an average of variations in signals outputted by the EGO sensors of the VDE under either a highest probable rich AFR condition or a highest probable lean AFR condition, over a plurality of engine cycles. As an example, a highest probable rich AFR condition may be considered a 35% rich imbalance, and a highest probable lean AFR condition may be considered a 35% lean imbalance. As shown in FIG. 2, variation in λ attributable to an AFR imbalance may be roughly symmetrical for lean and rich AFR's, where an amount of variation in λ attributable to a rich AFR may be similar to an amount of variation in λ attributable to a lean AFR.

At 606, method 600 includes estimating a variation in λ attributable to a non-deactivated intake valve and exhaust valve (e.g., a non-deactivated valve variation). The estimated variation in λ attributable to a non-deactivated intake valve and exhaust valve may be based on lookup tables (e.g. function of engine speed and load) obtained offline during the calibration process. In various embodiments, the non-deactivated valve variation may be an average of the variations in the signals outputted by the one or more EGO sensors of the VDE under a condition where an intake valve and an exhaust valve of the one or more deactivated cylinders are not deactivated, over a plurality of engine cycles.

At 608, method 600 includes establishing the threshold variation at a value higher than the baseline variation, and higher than the highest probable AFR imbalance variation, but lower than a typical variation in λ attributable to a non-deactivated valve. As can be seen in FIG. 2, even a large AFR imbalance of 35% does not result in a variation in λ as large as the variation generated by a non-deactivated valve. As a result, by establishing the threshold variation at a value between a highest probable value for variation attributable to an imbalance in AFR and a lowest probable value for variation attributable to a non-deactivated intake valve and exhaust valve, a variation in λ that exceeds the threshold variation may be a reliable indicator that the intake valve and exhaust valve of one of the one or more deactivated cylinders have remained activated, and have not been deactivated along with the respective cylinder.

As an additional or alternative check, a VDE diagnostic routine may be based on an outcome of an air-fuel imbalance ratio diagnostic during non-VDE mode. If variation in λ above a threshold variation is detected by the VDE diagnostic routine during VDE operation, and if an AFR imbalance is detected by the air-fuel ratio imbalance diagnostic during non-VDE operation, the VDE diagnostic routine may attribute the threshold variation in λ during the VDE mode to an AFR imbalance. Alternatively, if a variation in λ above a threshold variation is detected by the VDE diagnostic routine during VDE operation, and if an AFR imbalance is not detected by the air-fuel ratio imbalance diagnostic during non-VDE operation, the VDE diagnostic routine may attribute the threshold variation in λ during VDE operation to a non-deactivated valve. It should be appreciated that the air-fuel ratio imbalance diagnostic may be based on a variation in λ, similar to the VDE diagnostic, but with different thresholds, different enablement criteria, different number of engine cycles used, etc. The air-fuel ratio imbalance diagnostic may also be based on other measurements and methods (e.g. crankshaft acceleration).

Establishment of the threshold variation may be clarified by FIG. 4, which shows a graph 400 comparing an example variation in EGO signals (λ) generated by a non-deactivated intake/exhaust valve alongside a plot of λ variations generated by a lean or rich AFR of a VDE. The x axis of graph 400 indicates an AFR balance, where a dashed line 401 indicates an AFR with no imbalance (e.g., none of the firing cylinders are running rich or lean relative to other firing cylinders of a same bank), a dashed line 403 indicates an AFR with a 35% lean imbalance (e.g., a firing cylinder is running 35% leaner relative to the other firing cylinders of the same bank), and a dashed line 405 indicates an AFR with a 35% rich imbalance (e.g., a firing cylinder is running 35% richer relative to the other firing cylinders of the same bank). They axis of graph 400 indicates a variation in λ as an absolute value. Thus, point 402 indicates a low, baseline variation in λ, which may be seen under normal operating conditions with no degraded actuation mechanisms and a balanced AFR. Point 402 may be consistent with plot 202 of FIG. 2.

Variation in λ may increase as the AFR (among firing cylinders) becomes more unbalanced, as indicated previously in FIG. 2. A line 406 shows an increase in variation in λ as the AFR imbalance becomes increasingly lean, ending at a point 412 representing a highest probable variation in λ due to an AFR imbalance when line 406 intersects with dashed line 403 indicating a 35% lean imbalance, a hypothetical maximum lean imbalance for the purposes of calculating variation in λ. For example, the variation in λ indicated by point 412 is higher than the variation in λ indicated by a point 410, corresponding to a lean imbalance that is less than 35%. Similarly, a line 408 shows an increase in variation in λ as the AFR imbalance becomes increasingly rich, until line 408 intersects with dashed line 405 indicating a 35% rich imbalance, a hypothetical maximum rich imbalance for the purposes of calculating variation in λ. As can be seen in graph 400 and also in plots 206 and 208 of FIG. 2, variation in λ may be symmetrical with respect to leaner or richer AFR mixtures.

A high variation in λ is shown by point 404, which may be seen when one or more valves of deactivated cylinders remain activated. As can be seen in graph 400, the variation in λ caused by one or more non-deactivated valves may be substantially higher than the variation in λ caused by either a rich AFR imbalance or a lean AFR imbalance, as well as the baseline variation indicated by point 402. Therefore, a threshold variation in λ may be established at a point 413 on the y axis, indicated by a dashed line 414, which is advantageously positioned above a y-value of point 412 indicating the highest probable variation in λ due to an AFR imbalance and below point 404 indicating the variation in λ caused by one or more non-deactivated valves. Thus, variations in λ detected above the threshold variation represented by dashed line 414 may be attributed to one or more non-deactivated valves, while variations in λ detected below the threshold variation represented by dashed line 414 may be attributed to either a rich or a lean AFR imbalance.

Figure 7:
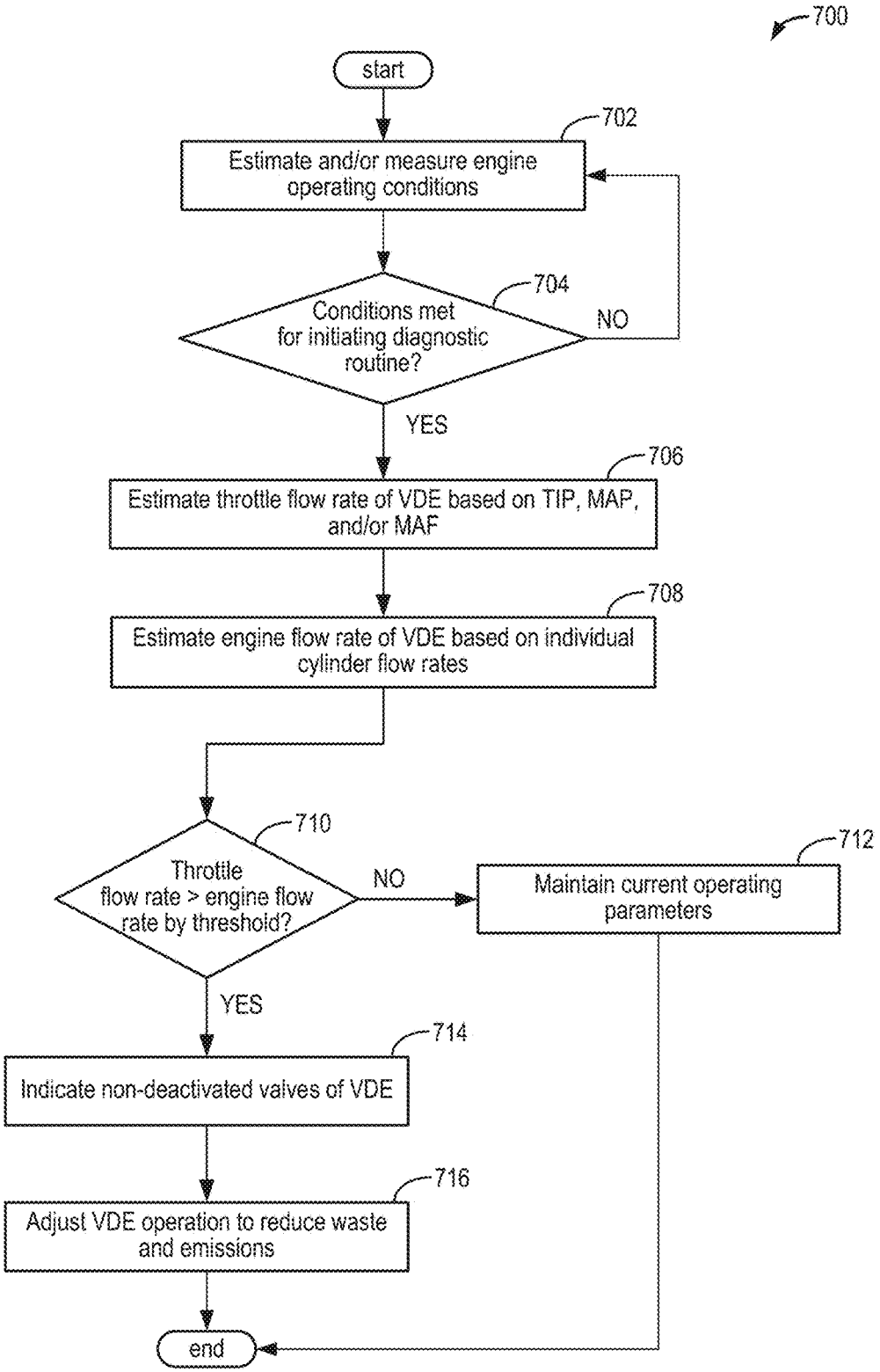
FIG. 7 shows a flow chart illustrating a second exemplary method for detecting a non-deactivated valve of a VDE.

Turning now to FIG. 7, an alternative exemplary method 700 is shown for detecting non-deactivated intake and exhaust valves of a deactivated cylinder of a VDE, as part of a valve deactivation diagnostic routine of the VDE. Method 700 leverages the fact that under steady-state operation or quasi-steady operation, a throttle air flow rate and engine air flow rate are equal, but throttle and engine air flow rate may differ during transients. For the purposes of this disclosure, quasi-steady operation may be defined, for example, as operation where a rate of change in engine speed is below a first threshold (e.g., ±200 RPM per second or ±5% per second), and a rate of change in engine load is below a second threshold (e.g., ±5% per second).

At 702, method 700 includes estimating and/or measuring engine operating conditions, as described above in reference to method 500 of FIG. 5. For example, operating conditions may include, but are not limited to, a status of the engine (e.g., determining whether a VDE of the vehicle is switched on, and how many cylinders of the VDE are firing), an AFR of fuel delivered at the cylinders of the VDE, and a status of one or more diagnostic routines operating in the engine system or exhaust system.

At 704, method 700 includes determining whether conditions have been met for initiating the valve deactivation diagnostic routine. Conditions for initiating the valve deactivation diagnostic routine may include, for example, the VDE operating in with one or more cylinders of the VDE deactivated (e.g., in a VDE mode), and a detection of higher-than-normal levels of oxygen in an exhaust gas of the VDE as measured by one or more EGO sensors (e.g., sensor 128 of FIG. 1). For example, if an increase in exhaust gas oxygen above a threshold is detected by an EGO sensor of a cylinder of the VDE, the valve deactivation diagnostic routine of method 700 may be initiated, and if an increase in the exhaust gas oxygen is not detected by the EGO sensor or if the increase in exhaust gas oxygen does not exceed the threshold, the valve deactivation diagnostic routine may not be initiated.

Some of the conditions for initiating the valve deactivation diagnostic routine of alternative method 700 may be different than those of method 500. For example, when enabled during quasi-steady operation (e.g. rate of change in engine speed is below the first threshold and rate of change in engine load is below the second threshold), the thresholds used for method 700 may be different from those of method 500. Additionally, a speed/load enablement grid may be different from the enablement grid for method 500. As method 700 is based on comparing throttle air flow to engine air flow, the method may not be executed where throttle air flow estimates and/or engine air flow estimates do not have sufficient accuracy. For example, if throttle air flow is based on a pressure differential across the throttle body instead of a MAF sensor measurement, the throttle air flow estimate may be inaccurate at operating conditions where the pressure differential across the throttle body is small (e.g., high load conditions).

Method 500 may be less reliable than method 700 at low load conditions where the EGO sensor transient response is slow, resulting in inadequate signal-to-noise ratio. Alternatively, Method 700 may be less reliable than method 500 at high load conditions where the pressure differential across the throttle body is small (e.g., less than 3 or 5 kPa). In some embodiments, methods 500 and 700 may be enabled in different operating regions, and/or may both be used to complement one another, enabling execution over a wider range of engine operating conditions during VDE mode.

If at 704 it is determined that conditions have not been met for initiating the valve deactivation diagnostic routine, method 700 proceeds back to 702 until the conditions are met. If at 704 it is determined that conditions have been met for initiating the valve deactivation diagnostic routine, method 700 proceeds to 706.

At 706, method 700 includes estimating a throttle air flow rate of the VDE. In various embodiments, the throttle air flow rate may be estimated based on throttle opening, throttle inlet pressure (TIP) and temperature, and pressure drop across the throttle, which may be measured using a differential pressure sensor, or computed as TIP minus MAP. In other embodiments, a mass air flow (MAF) sensor may be used to estimate the throttle air flow rate. It should be appreciated that the computation of the throttle air flow estimate does not depend on how many cylinders are inducting. One or more cylinders with at least one intake valve (each) and at least one exhaust valve (each) that have not been deactivated do not impact the computation of the throttle air flow estimate, since the throttle air flow estimate is based on a combination mass flow, pressure, temperature and throttle opening measurements where knowledge of the acutal number of inducting cylinder is not relied on.

At 708, method 700 includes estimating an engine air flow rate based on each individual cylinder flow rate. Engine air flow rate may be estimated by multiplying an individual cylinder flow rate by a number of inducting cylinders (corresponding to a condition with no VDE malfunction), where the individual cylinder flow rate may be based on various parameters including intake MAP, intake manifold charge temperature (MCT), engine speed, intake valve timing, exhaust valve timing, and/or other parameters. The individual cylinder flow rate may be a function on the mass inducted to or trapped in the relevant individual cylinder per engine cycle multiplied by a number of cycles completed per unit time (e.g., a function of engine speed). The trapped mass may be a function of the cylinder volume, charge density (e.g., a function of MAP and MCT), and volumetric efficiency (e.g., a function of MAP, engine speed, intake and exhaust valve timing, exhaust pressure, etc.).

In some embodiments, the calculation of cylinder flow rate may include lookup tables for volumetric efficiency (e.g., a function of or a subset of MAP, engine speed, intake and exhaust valve timing, exhaust pressure, etc.) and modifiers for charge density (e.g., based on MAP and MCT measurements).

Unlike the throttle air flow, the computation of the engine air flow estimate may depend on how many cylinders are inducting. One or more cylinders with at least one intake valve (each) and at least one exhaust valve (each) that have not been deactivated may result in a large error in the computed engine air flow estimate. For example, a V-8 operating in VDE-V4 mode (e.g., where four of the eight cylinders have been deactivated) with one deactivated cylinder still inducting due to a non-deactivated intake and exhaust valve will have five inducting cylinders instead of four, generating an easily detectable 25% error in engine air flow.

With five cylinders inducting instead of four, a MAF sensor-based throttle air flow estimate directly measures air flow rate detecting the additional flow from the still inducting deactivated cylinder and providing an accurate estimate of the flow. Similarly, a throttle air flow estimate based on TIP, MAP and throttle angle measures the impact of the additional flow on MAP and/or throttle opening and (indirectly) detects the additional flow from the still inducting deactivated cylinder, also providing an accurate estimate of the flow. An engine air flow estimate may accurately compute an individual cylinder flow rate (e.g., based on volumetric efficiency lookup tables and charge density), but may underestimate the engine air flow, as it may underestimate the actual number of inducting cylinders (the engine air flow calculations assume four inducting cylinders corresponding to normal VDE operation instead of the actual five inducting cylinders due to an intake and exhaust valve malfunction). As a result, the computed engine air flow may be substantially smaller than the computed throttle air flow due to an inducting deactivated cylinder.

At 710, method 700 includes determining whether the computed throttle air flow rate is greater than the computed engine air flow rate by a threshold (e.g., 20%). (It should be appreciated that the computed throttle and engine air flow rates are different from the actual throttle and engine air flow rates, which may still be equal.) If at 710 it is determined that the computed throttle air flow rate is not greater than the computed engine air flow rate by the threshold, method 700 proceeds to 712. At 712, method 700 includes maintaining current operating parameters of the VDE, and method 700 ends. Alternatively, if at 710 it is determined that the computed throttle air flow rate is greater than the computed engine air flow rate by the threshold, method 700 proceeds to 714. At 714, method 700 includes indicating non-deactivated valves at the one or more cylinders.

In some embodiments, a plurality of thresholds may be used to indicate whether more than one deactivated cylinder has non-deactivated valves. For example, a computed throttle air flow rate greater than the computed engine air flow rate by a first threshold (e.g., 20%) may indicate that one deactivated cylinder has non-deactivated valves, a computed throttle air flow rate greater than the computed engine air flow rate by a second threshold (e.g., 40%) may indicate that two deactivated cylinders has non-deactivated valves, and so on.

At 716, in response to detecting non-deactivated valves at the one or more cylinders, method 700 includes adjusting an operation of the VDE to correct for any fuel wasted, excess energy produced, or emissions generated by the one or more cylinders with the non-deactivated valves, as described above in reference to method 500. Method 700 ends.

Thus, robust systems and methods are provided to accurately detect a degradation in a valve deactivation actuation mechanism that causes valves of a cylinder of a VDE not to deactivate when the cylinder is deactivated during operation in a VDE mode. As described herein, the degraded valve deactivation actuation mechanism may be detected by estimating a variation in signals generated by an EGO sensor arranged in an exhaust passage, and determining whether the variation is above a threshold. If the variation is above the threshold, it may be deduced that the actuation mechanism is degraded; if the variation is below the threshold, it may be deduced that the variation is due to a rich or lean AFR imbalance. A second, alternative method is also provided, whereby an estimated (e.g., computed) throttle air flow of the VDE is compared with an estimated or computed engine air flow of the VDE during operation in the VDE mode. Since the throttle air flow estimate does not depend on a number of cylinders that are inducting, and the engine air flow estimate does depend on the number of cylinders that are inducting, a comparison of the estimated throttle air flow with the estimated engine air flow may be used to determine whether valves of one or more cylinders have remained activated when the one or more cylinders have been deactivated. If the throttle air flow is greater than the engine air flow by a threshold, the non-deactivated valves may be indicated. If the estimated throttle air flow is not greater than the estimated engine air flow by the threshold, it may be deduced that the valves of the one or more deactivated cylinders have been deactivated. Further, additional thresholds may be used to determine a number of cylinders with non-deactivated valves. In this way, a diagnostic routine to detect non-deactivated valves may be based on the variation in λ or the comparison between the estimated throttle air flow and the estimated engine air flow rather than an increase in an oxygen level of exhaust gases, resulting in more accurate diagnosis of the degraded actuation mechanism. In some embodiments, a first method based on the variation in λ and a second method based on the comparison between the estimated/computed throttle air flow and the estimated/computed engine air flow may both be used in conjunction by a diagnostic routine, for example, where a mitigating action may be based on the first method and the second method confirming a diagnosis. As a result, a waste of fuel and corresponding increase in emissions caused by mistakenly attempting to address the problem by adjusting the AFR to a richer mixture may be averted, and effects of the degraded actuation mechanism may be mitigated by activating the deactivated cylinders.

The technical effect of diagnosing one or more non-deactivated valves of a deactivated cylinder is that a fuel efficiency of the VDE may be increased and an amount of emissions of the VDE may be reduced.

The disclosure also provides support for a method for a controller of a variable displacement engine (VDE), comprising: during operation of the VDE with one or more cylinders of the VDE deactivated: calculating a variation in a fast-sampled signal outputted by one or more exhaust gas oxygen (EGO) sensors of the VDE over a plurality of engine cycles, determining that the variation is greater than the threshold variation, and in response, indicating that at least one intake valve and at least one exhaust valve of the one or more cylinders are not deactivated. In a first example of the method, calculating the variation in the fast-sampled signal includes: sampling a signal of an EGO sensor of the one or more EGO sensors at a rate at least twice a firing rate of activated cylinders sharing the EGO sensor, collecting signal samples spanning one engine cycle in a first-in-first-out (FIFO) buffer, and at least one of: performing a statistical operation on the samples to generate a de-trended signal, and rectifying the de-trended signal by one of averaging and summing an absolute value of the de-trended signal over a predetermined number of engine cycles to generate a measurement of the variation, calculating a standard deviation of the samples, calculating an amplitude or a peak-to-peak amplitude of the samples, taking an absolute value of a derivative of the samples, and calculating a magnitude of frequency components of the samples at engine-cycle frequency or an integer multiple of engine-cycle frequency. In a second example of the method, optionally including the first example, performing the statistical operation on the samples includes one of: subtracting a median signal of the samples from the middle buffer element, subtracting a mean signal of the samples from the middle buffer element. In a third example of the method, optionally including one or both of the first and second examples, the threshold variation is calculated by: estimating a baseline variation, based on a nominal expected AFR imbalance in a VDE where all intake and exhaust valves of all deactivated cylinders are deactivated, averaged over a plurality of engine cycles, estimating a highest probable air fuel ratio (AFR) imbalance variation, the highest probable AFR imbalance variation an average of the variations in the signals outputted by the one or more EGO sensors of the VDE under a highest probable rich AFR imbalance condition and/or a highest probable lean AFR imbalance condition, over a plurality of engine cycles, estimating a non-deactivated valve variation, the non-deactivated valve variation an average of the variations in the signals outputted by the one or more EGO sensors of the VDE under a condition where at least one intake valve and at least one exhaust valve of the one or more deactivated cylinders are not deactivated, over a plurality of engine cycles, and establishing the threshold variation higher than the baseline variation and higher than the highest probable AFR imbalance variation, but lower than the non-deactivated valve variation. In a fourth example of the method, optionally including one or more or each of the first through third examples, the highest probable rich AFR imbalance condition is a 35% rich imbalance, and the highest probable lean AFR imbalance condition is a 35% lean imbalance. In a fifth example of the method, optionally including one or more or each of the first through fourth examples, the one or more EGO sensors include a universal exhaust gas oxygen (UEGO) sensor. In a sixth example of the method, optionally including one or more or each of the first through fifth examples, the method further comprises: in response to the variation being greater than a threshold variation, adjusting an operation of the VDE to selectively activate all or different cylinders of the VDE. In a seventh example of the method, optionally including one or more or each of the first through sixth examples, the method further comprises: in a first condition, where the variation in the signal outputted by the one or more EGO sensors is greater than a threshold variation, indicating that valves of one or more cylinders of the VDE are not deactivated, and in a second condition, where the variation in the signal outputted by the one or more EGO sensors is not greater than a threshold variation, not indicating that valves of the one or more cylinders of the VDE are not deactivated.

The disclosure also provides support for a method for a controller of a variable displacement engine (VDE), comprising: during a steady-state or quasi-steady operation of the VDE with one or more cylinders of the VDE deactivated, where the one or more cylinders of the VDE being deactivated includes the intake valve and the exhaust valve being commanded to be held in a closed position, estimating a throttle air flow rate and an engine air flow rate of the VDE, and in response to the estimated throttle air flow rate exceeding the estimated engine air flow rate by a threshold, indicating that an intake valve and an exhaust valve of at least one of the one or more deactivated cylinders is not being held in a closed position. In a first example of the method, the threshold is a threshold percentage. In a second example of the method, optionally including the first example, the method further comprises: estimating the throttle flow rate based on at least one of an opening of a throttle of the VDE, a throttle inlet pressure (TIP), a throttle inlet temperature, and a pressure drop across the throttle. In a third example of the method, optionally including one or both of the first and second examples, the pressure drop across the throttle is measured using a differential pressure sensor. In a fourth example of the method, optionally including one or more or each of the first through third examples, the pressure drop across the throttle is calculated by subtracting an intake manifold absolute pressure (MAP) from the TIP. In a fifth example of the method, optionally including one or more or each of the first through fourth examples, the method further comprises: estimating the throttle flow rate based on an output of a mass air flow (MAF) sensor of the VDE. In a sixth example of the method, optionally including one or more or each of the first through fifth examples, estimating the engine flow rate includes multiplying an individual cylinder flow rate by a number of inducting cylinders of the VDE corresponding to a condition with no VDE malfunction, the individual cylinder flow rate estimated based on at least one of the intake MAP, an intake manifold charge temperature (MCT), an engine speed, an intake valve timing, and an exhaust valve timing. In a seventh example of the method, optionally including one or more or each of the first through sixth examples, indicating non-deactivated valves of one or more deactivated cylinders if the throttle air flow rate exceeds the engine air flow rate by a threshold further comprises indicating non-deactivated valves of a plurality of deactivated cylinders based on whether the throttle air flow rate exceeds the engine air flow rate by a respective plurality of thresholds.

The disclosure also provides support for a system for controlling a variable displacement engine (VDE) of a vehicle, comprising: a controller with computer readable instructions stored on non-transitory memory that when executed during operation of the VDE, cause the controller to: during operation of the VDE with one or more cylinders of the VDE deactivated: execute a diagnostic routine to determine whether valves of one or more deactivated cylinders have not been deactivated, the diagnostic routine comprising at least one of: calculating a variation in a fast-sampled signal outputted by the one or more EGO sensors over a plurality of engine cycles, and in response to the variation being greater than a threshold variation, indicating non-deactivated valves of the one or more deactivated cylinders, and estimating a throttle air flow rate and an engine air flow rate of the VDE, and indicating non-deactivated valves of the one or more deactivated cylinders if the throttle air flow rate exceeds the engine air flow rate by a threshold, and in response to an indication of non-deactivated valves of the one or more deactivated cylinders, activate the one or more deactivated cylinders, set a malfunction indicator light (MIL), and/or adjust the operation of the VDE. In a first example of the system, calculating the variation in the fast-sampled signal further comprises: collecting signal samples spanning 1 engine cycle in a first-in-first-out (FIFO) buffer, and subtracting a median signal of the samples from the middle buffer element to generate a de-trended signal, and averaging and summing an absolute value of the de-trended signal over a predetermined number of engine cycles. In a second example of the system, optionally including the first example, the threshold variation is a predetermined threshold variation established between a hypothetical variation attributable to a highest probable air fuel ratio (AFR) imbalance and a typical variation attributable to a non-deactivated intake and exhaust valve, where: the highest probable AFR imbalance variation is an average of variations in the signals outputted by the one or more EGO sensors under a richest probable AFR imbalance condition and a leanest probable AFR imbalance condition, over a plurality of engine cycles, and the non-deactivated valve variation is an average of variations in the signals outputted by the one or more EGO sensors under a condition where an intake valve and an exhaust valve of the one or more deactivated cylinders are not deactivated, over a plurality of engine cycles. In a third example of the system, optionally including one or both of the first and second examples, further instructions are stored on the non-transitory memory that when executed during operation of the VDE, cause the controller to estimate the throttle air flow rate based on an opening of a throttle of the VDE, a throttle inlet pressure (TIP), a throttle inlet temperature, and a pressure drop across the throttle, and estimate the engine flow rate by multiplying an individual cylinder flow rate by a number of inducting cylinders of the VDE corresponding to a condition where all intake and exhaust valves of the number of inducting cylinders are not malfunctioning, the individual cylinder flow rate estimated based on at least one of the intake MAP, an intake manifold charge temperature (MCT), an engine speed, an intake valve timing, an exhaust manifold pressure, and an exhaust valve timing.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first,"

"second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a controller of a variable displacement engine (VDE), comprising:

during operation of the VDE with one or more cylinders of the VDE deactivated:

calculating a variation in a fast-sampled signal outputted by one or more exhaust gas oxygen (EGO) sensors of the VDE over a plurality of engine cycles;

determining that the variation is greater than the threshold variation, and in response, indicating that at least one intake valve and at least one exhaust valve of the one or more cylinders are not deactivated, wherein calculating the variation in the fast-sampled signal includes:

sampling a signal of an EGO sensor of the one or more EGO sensors at a rate at least twice a firing rate of activated cylinders sharing the EGO sensor;

collecting signal samples spanning one engine cycle in a first-in-first-out (FIFO) buffer, and at least one of:

performing a statistical operation on the samples to generate a de-trended signal, and rectifying the de-trended signal by one of averaging and summing an absolute value of the de-trended signal over a predetermined number of engine cycles to generate a measurement of the variation;

calculating a standard deviation of the samples;

calculating an amplitude or a peak-to-peak amplitude of the samples;

taking an absolute value of a derivative of the samples; and calculating a magnitude of frequency components of the samples at engine-cycle frequency or an integer multiple of engine-cycle frequency.

2. The method of claim 1, wherein performing the statistical operation on the samples includes one of:

subtracting a median signal of the samples from the middle buffer element;

subtracting a mean signal of the samples from the middle buffer element.

3. The method of claim 1, wherein the threshold variation is calculated by:

estimating a baseline variation, based on a nominal expected AFR imbalance in a VDE where all intake and exhaust valves of all deactivated cylinders are deactivated, averaged over a plurality of engine cycles;

estimating a highest probable air fuel ratio (AFR) imbalance variation, the highest probable AFR imbalance variation an average of the variations in the signals outputted by the one or more EGO sensors of the VDE under a highest probable rich AFR imbalance condition and/or a highest probable lean AFR imbalance condition, over a plurality of engine cycles;

estimating a non-deactivated valve variation, the non-deactivated valve variation an average of the variations in the signals outputted by the one or more EGO sensors of the VDE under a condition where at least one intake valve and at least one exhaust valve of the one or more deactivated cylinders are not deactivated, over a plurality of engine cycles; and establishing the threshold variation higher than the baseline variation and higher than the highest probable AFR imbalance variation, but lower than the non-deactivated valve variation.

4. The method of claim 3, wherein the highest probable rich AFR imbalance condition is a 35% rich imbalance, and the highest probable lean AFR imbalance condition is a 35% lean imbalance.

5. The method of claim 1, wherein the one or more EGO sensors include a universal exhaust gas oxygen (UEGO) sensor.

6. The method of claim 1, further comprising:

in response to the variation being greater than a threshold variation, adjusting an operation of the VDE to selectively activate all or different cylinders of the VDE.

7. The method of claim 1, further comprising:

in a first condition, where the variation in the signal outputted by the one or more EGO sensors is greater than a threshold variation, indicating that valves of one or more cylinders of the VDE are not deactivated; and in a second condition, where the variation in the signal outputted by the one or more EGO sensors is not greater than a threshold variation, not indicating that valves of the one or more cylinders of the VDE are not deactivated.

8. A method for a controller of a variable displacement engine (VDE), comprising:

during a steady-state or quasi-steady operation of the VDE with one or more cylinders of the VDE deactivated, where the one or more cylinders of the VDE being deactivated includes the intake valve and the exhaust valve being commanded to be held in a closed position, estimating a throttle air flow rate and an engine air flow rate of the VDE; and in response to the estimated throttle air flow rate exceeding the estimated engine air flow rate by a threshold, indicating that an intake valve and an exhaust valve of at least one of the one or more deactivated cylinders is not being held in a closed position.

9. The method of claim 8, wherein the threshold is a threshold percentage.

10. The method of claim 8, further comprising estimating the throttle flow rate based on at least one of an opening of a throttle of the VDE, a throttle inlet pressure (TIP), a throttle inlet temperature, and a pressure drop across the throttle.

11. The method of claim 10, wherein the pressure drop across the throttle is measured using a differential pressure sensor.

12. The method of claim 10, wherein the pressure drop across the throttle is calculated by subtracting an intake manifold absolute pressure (MAP) from the TIP.

13. The method of claim 8, further comprising estimating the throttle flow rate based on an output of a mass air flow (MAF) sensor of the VDE.

14. The method of claim 8, wherein estimating the engine flow rate includes multiplying an individual cylinder flow rate by a number of inducting cylinders of the VDE corresponding to a condition with no VDE malfunction, the individual cylinder flow rate estimated based on at least one of the intake MAP, an intake manifold charge temperature (MCT), an engine speed, an intake valve timing, and an exhaust valve timing.

15. The method of claim 8, wherein indicating non-deactivated valves of one or more deactivated cylinders if the throttle air flow rate exceeds the engine air flow rate by a threshold further comprises indicating non-deactivated valves of a plurality of deactivated cylinders based on whether the throttle air flow rate exceeds the engine air flow rate by a respective plurality of thresholds.

16. A system for controlling a variable displacement engine (VDE) of a vehicle, comprising:

a controller with computer readable instructions stored on non-transitory memory that when executed during operation of the VDE, cause the controller to:

during operation of the VDE with one or more cylinders of the VDE deactivated:

execute a diagnostic routine to determine whether valves of one or more deactivated cylinders have not been deactivated, the diagnostic routine comprising at least one of:

calculating a variation in a fast-sampled signal outputted by the one or more EGO sensors over a plurality of engine cycles, and in response to the variation being greater than a threshold variation, indicating non-deactivated valves of the one or more deactivated cylinders; and estimating a throttle air flow rate and an engine air flow rate of the VDE, and indicating non-deactivated valves of the one or more deactivated cylinders if the throttle air flow rate exceeds the engine air flow rate by a threshold; and in response to an indication of non-deactivated valves of the one or more deactivated cylinders, activate the one or more deactivated cylinders, set a malfunction indicator light (MIL), and/or adjust the operation of the VDE.

17. The system of claim 16, wherein calculating the variation in the fast-sampled signal further comprises:

collecting signal samples spanning 1 engine cycle in a first-in-first-out (FIFO) buffer, and subtracting a median signal of the samples from the middle buffer element to generate a de-trended signal; and averaging and summing an absolute value of the de-trended signal over a predetermined number of engine cycles.

18. The system of claim 16, wherein the threshold variation is a predetermined threshold variation established between a hypothetical variation attributable to a highest probable air fuel ratio (AFR) imbalance and a typical variation attributable to a non-deactivated intake and exhaust valve, where:

the highest probable AFR imbalance variation is an average of variations in the signals outputted by the one or more EGO sensors under a richest probable AFR imbalance condition and a leanest probable AFR imbalance condition, over a plurality of engine cycles; and the non-deactivated valve variation is an average of variations in the signals outputted by the one or more EGO sensors under a condition where an intake valve and an exhaust valve of the one or more deactivated cylinders are not deactivated, over a plurality of engine cycles.

19. The system of claim 16, wherein further instructions are stored on the non-transitory memory that when executed during operation of the VDE, cause the controller to estimate the throttle air flow rate based on an opening of a throttle of the VDE, a throttle inlet pressure (TIP), a throttle inlet temperature, and a pressure drop across the throttle, and estimate the engine flow rate by multiplying an individual cylinder flow rate by a number of inducting cylinders of the VDE corresponding to a condition where all intake and exhaust valves of the number of inducting cylinders are not malfunctioning, the individual cylinder flow rate estimated based on at least one of the intake MAP, an intake manifold charge temperature (MCT), an engine speed, an intake valve timing, an exhaust manifold pressure, and an exhaust valve timing.

* * * * *